United States Patent [19]

Friestad

[11] Patent Number: 5,027,638

[45] Date of Patent: Jul. 2, 1991

[54] FORCE-RESISTING STRUCTURE

[76] Inventor: Roland W. Friestad, 1640 N. Kellogg, Galesburg, Ill. 61401

[21] Appl. No.: 542,319

[22] Filed: Jun. 22, 1990

[51] Int. Cl.[5] ..... B21D 37/12

[52] U.S. Cl. ..... 72/455; 72/453.01; 72/456; 100/214

[58] Field of Search ..... 72/455, 456, 453.01; 100/214, 295

[56] References Cited

U.S. PATENT DOCUMENTS

| | | | |
|---|---|---|---|
| 3,418,923 | 12/1968 | Zeitlin et al. | 72/455 |
| 3,479,856 | 11/1969 | Boggio et al. | 72/455 |
| 3,508,429 | 4/1970 | Staples | 72/455 |
| 3,545,372 | 12/1970 | Mueller | 72/455 |
| 3,668,920 | 6/1972 | Grankowski et al. | 72/455 |
| 3,717,024 | 2/1973 | Davison | 72/455 |
| 4,461,164 | 7/1984 | Laviano | 72/455 |
| 4,615,208 | 10/1986 | Hailey | 72/455 |

FOREIGN PATENT DOCUMENTS

| | | | |
|---|---|---|---|
| 23105 | 2/1906 | Austria | 72/455 |
| 2114343 | 10/1972 | Fed. Rep. of Germany | 72/455 |
| 1275302 | 5/1972 | United Kingdom | 72/455 |

*Primary Examiner*—David Jones

*Attorney, Agent, or Firm*—Marshall, O'Toole, Gerstein, Murray & Bicknell

[57] ABSTRACT

A force-resisting structure, such as a press frame, is composed of a plurality of substantially planar loops each made from a single piece of metal plate. The loops are connected together in spaced, parallel relation by bolts which perform essentially no force-resisting function. The structure contains no welds. All components requiring machining are machined before assembly, and there are no machining operations thereafter.

9 Claims, 5 Drawing Sheets

FORCE-RESISTING STRUCTURE

BACKGROUND OF THE INVENTION

The present invention relates generally to structures for resisting opposed directional forces, such as press frames, and more particularly to structures of this type which are constructed without castings or weldments.

Force-resisting structures have forces applied thereto by external actuating mechanisms which may be hydraulic or mechanical, for example. Such a structure may include one or more large castings or may comprise an assembly of components, and the components of that assembly, or of subassemblies thereof, are often joined together by welding.

Force-resisting structures, such as press frames, require a certain amount of machining on various surfaces thereof. When the structure is a casting or a heavy weldment, large machining equipment, not available at many manufacturing facilities, must be employed.

A force-resisting structure composed of a number of smaller components welded together into an assembly has other significant problems. Care must be taken that the weld areas are not highly stressed, and the finished structure must often be machined after welding to remove the effects of distortion which can occur during the welding process. Machining the finished structure, after all the components have been welded together, involves handling difficulties and requires large machining equipment not available in many manufacturing facilities. Moreover, welded structures can also undergo metallurgical changes in the area of the weld that adversely affect the metal there and which may require further processing, such as heat treating, to offset such adverse effects.

Another expedient employed in producing force-resisting structures is a so-called "tie rod" construction, but this expedient requires special procedures to prestress the tie rods, reduce mechanical deflections and retain certain constituent members in the desired condition of stress.

SUMMARY OF THE INVENTION

A force-resisting structure in accordance with the present invention eliminates the disadvantages and drawbacks of the force-resisting structures described above. Neither large castings nor large weldments are employed. An all welded assembly composed of smaller components welded together is not employed. There is, therefore, no need for large machining equipment, and the distortion problem associated with a welded assembly is avoided. Metallurgical changes in the area around the weld are also avoided.

Basically, the structure comprises a plurality of substantially planar, metal loops or rings. Each loop constitutes a single piece formed from a single piece of metal plate, e.g. steel plate. Each loop is totally devoid of any weld. The loops are connected together in unwelded, mutually parallel relation to form the force-resisting structure. In the case of a press frame, two loops may be employed, a front loop and a back loop, for example. The loops are connected together with mechanical fasteners, such as bolts, but the mechanical fasteners do not participate, to any substantial extent, in resisting the main structural loads.

The parallel, spaced apart loops are maintained in spaced relation, in one embodiment, by spacers composed of standard plate or bar stock. All other components of the force-resisting structure are similarly composed of standard plate or bar stock.

The arrangements described in the preceding two paragraphs make machining easier and simplify assembly because all of the components requiring machining can be initially finish machined, before assembly. There is no need to perform welding, stress relief, and subsequent machining operations, as would have been necessary if the structure were an assembly composed of smaller components welded together. The present invention requires merely initial machining of the unassembled components and then bolting the components together. This also facilitates the manufacture of replacement parts for the components of the force-resisting structure.

Other features and advantages are inherent in the structure claimed and disclosed or will become apparent to those skilled in the art from the following detailed description in conjunction with the accompanying diagrammatic drawings.

DETAILED DESCRIPTION

Figure 3:
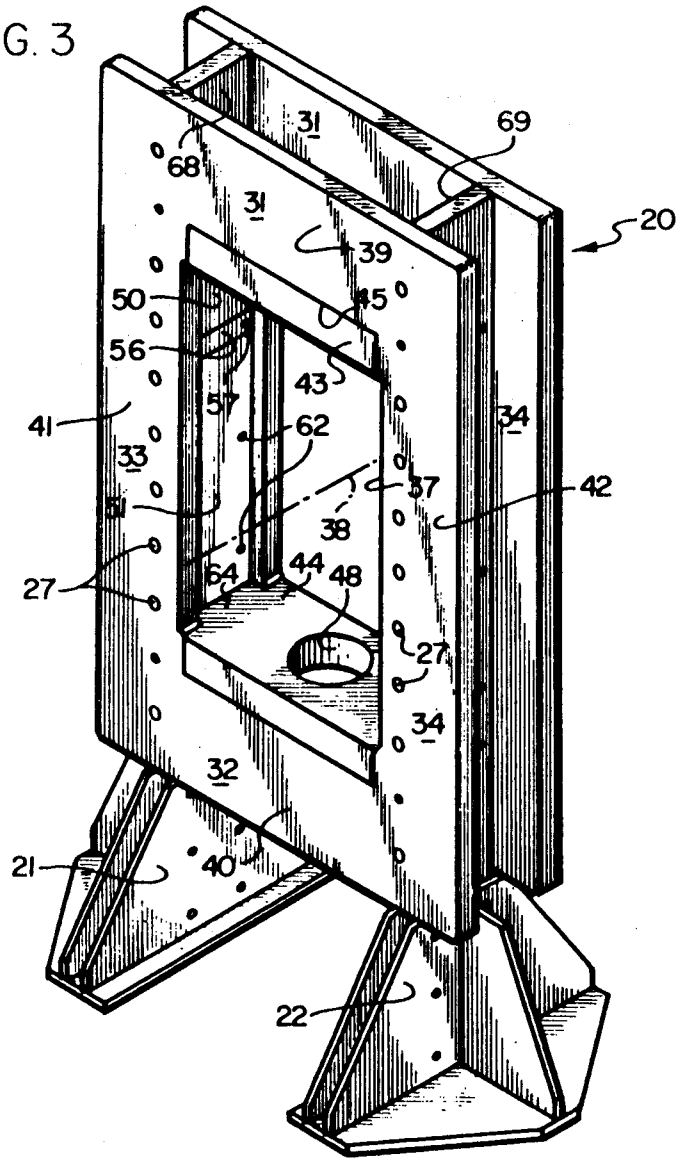
FIG. 3 is a perspective showing the press frame of FIG. 1 fully assembled.

Referring initially to FIG. 3, indicated generally at 20 is an embodiment of a force-resisting structure in the form of a press frame constructed in accordance with the present invention. Press frame 20 is supported in an elevated position above a floor by a pair of pedestals 21, 22.

Figure 1:
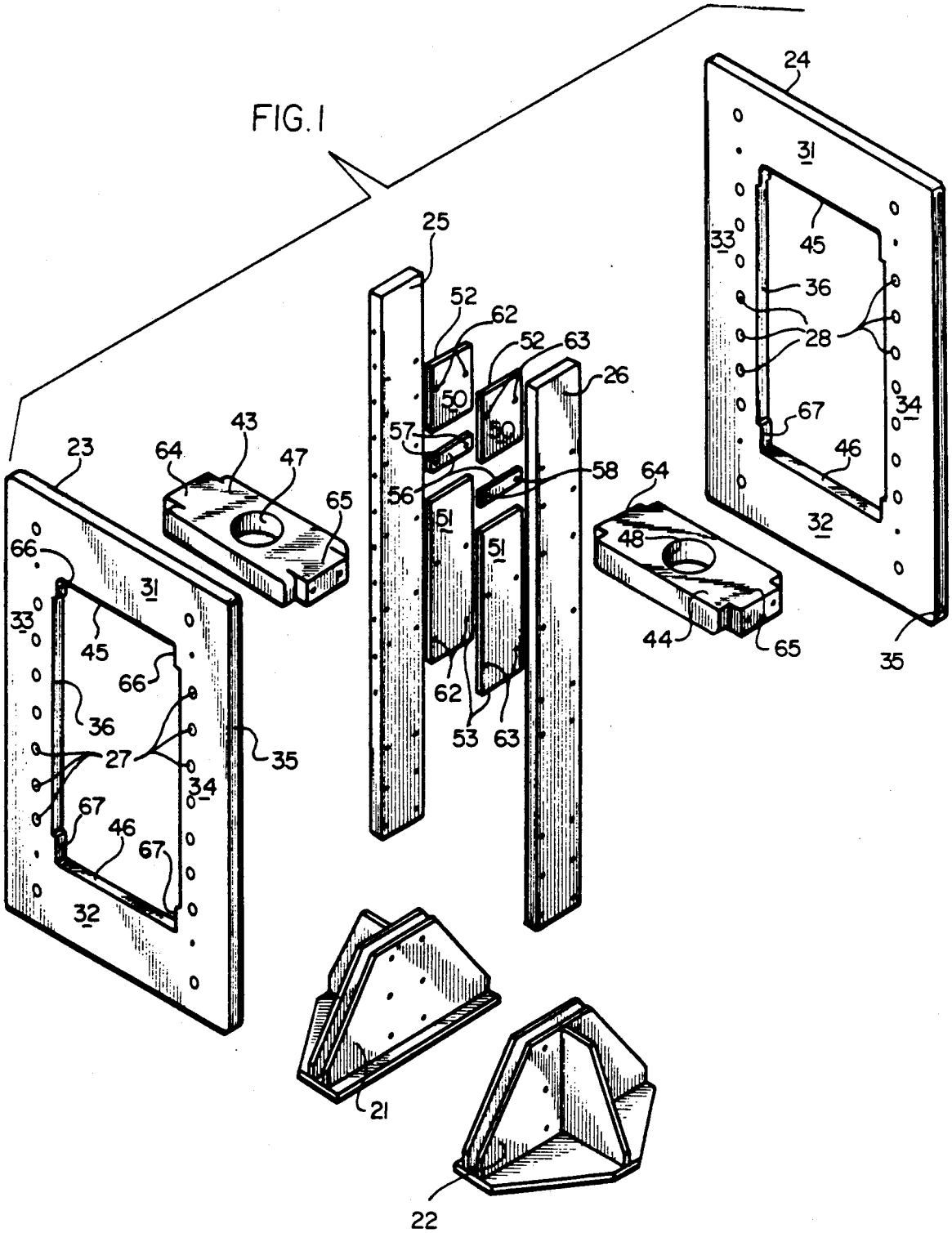
FIG. 1 is an exploded perspective of an embodiment of a press frame constructed in accordance with the present invention.
Figure 2:
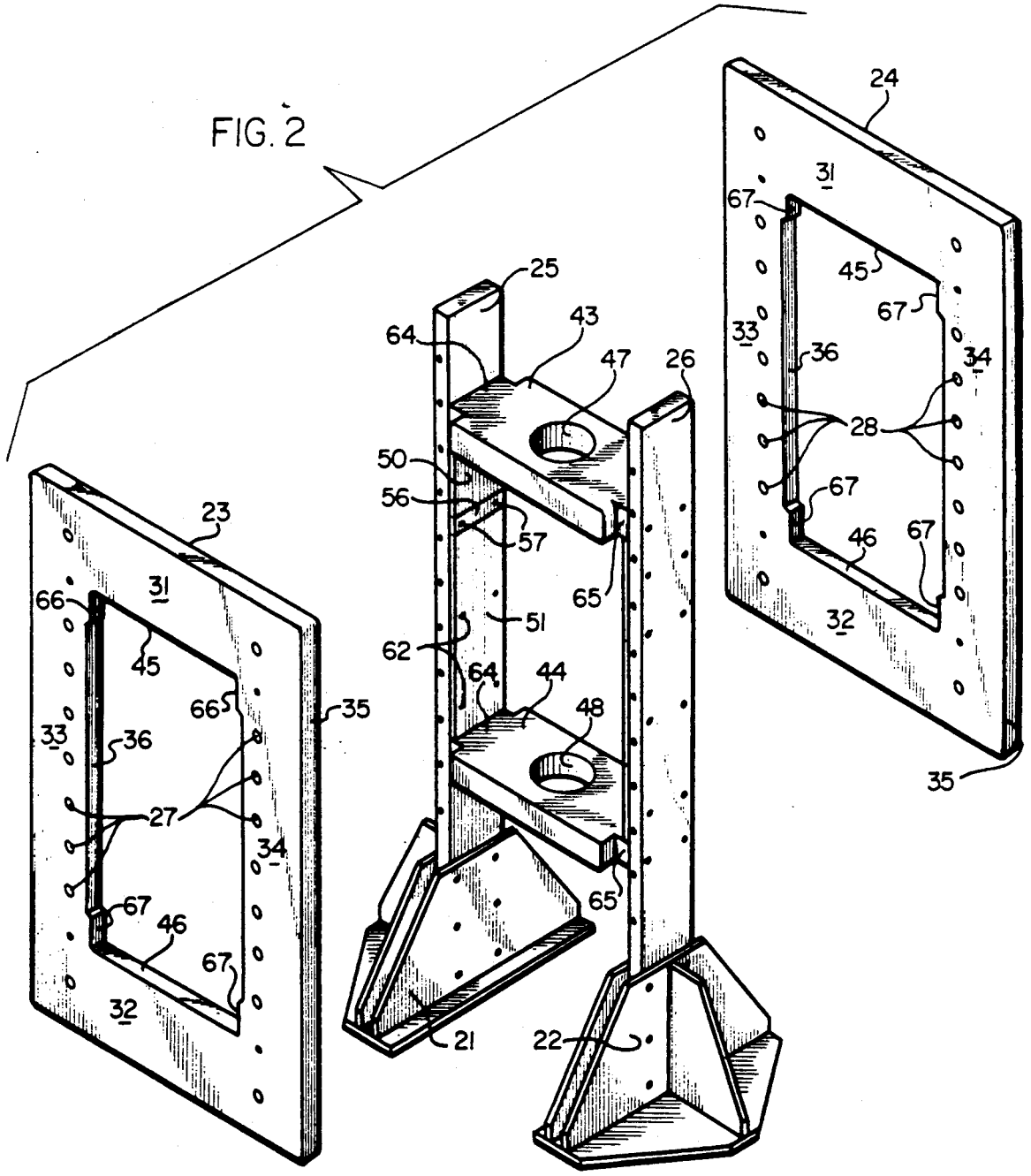
FIG. 2 is a perspective showing the press frame of FIG. 1 partially assembled.

As shown in FIGS. 1-3, press frame 20 comprises a plurality of substantially planar, metal loops or rings, in this case a front loop 23 and a back loop 24. Loops 23, 24 are connected together and maintained in alignment by a pair of spacer members or spines 25, 26 which extend upwardly from pedestals 21, 22 respectively. Front loop 23 is fastened to the front sides of spacer members 25, 26 by bolts at locations 27 on front loop 23; and back loop 24 is fastened to the back sides of spacer members 25, 26 by bolts at locations 28 on back loop 24. The bolts at 27, 28 perform essentially only a fastening function. They do not participate, to any significant extent, in resisting the main structural loads applied to loops 23, 24 in a manner to be subsequently described.

When front and back loops 23, 24 are assembled in the manner shown in FIG. 3, each side portion 33, 34 on front loop 23 faces a corresponding respective side portion 33, 34 on back loop 24. Spacer members 25, 26 are located between corresponding, facing side portions 33, 33 and 34, 34 respectively.

Each of the two loops 23, 24 has essentially the same characteristics and properties, and the following description is equally applicable to both front loop 23 and back loop 24.

Each loop constitutes a single piece formed from a single piece of metal plate, e.g. steel plate. The loop 23 has a pair of spaced apart, opposed end portions, in this case an upper end portion 31 and a lower end portion 32. In addition, the loop has a pair of spaced apart, opposed side portions 33, 34 extending between and integral with each of end portions 31, 32. Each loop end portion and each loop side portion has an exterior edge, and these exterior edges together define the periphery 35 of the loop. Similarly, each loop end portion and each loop side portion has an interior edge, and these interior edges together define the interior opening 36 of the loop.

As noted above, each loop 23, 24 constitutes a single piece formed from a single piece of metal plate, and therefore each loop is devoid of any weld. The bolts at locations 27, 28, which fasten loops 23, 24 to spacer members 25, 26 connect the loops together in unwelded, mutually parallel relation to form the basic force-resisting structure. This structure will resist opposed directional forces; in the particular case involving press frame 20, the opposed forces are up and down forces directed toward loop upper and lower end portions 31, 32 respectively.

Interior opening 36 of front loop 23 is aligned with the interior opening 36 of back loop 24 to form an interior opening 37 for the force-resisting structure. As shown in FIG. 3, opening 37 has a center line 38 disposed transversely to the direction of the opposed forces (i.e. the up and down forces) resisted by press frame 20.

With further reference to FIG. 3, press frame 20 has a first or upper end 39 comprising the upper end portions 31, 31 of front and back loops 23, 24. Similarly, frame 20 has a second or lower end 40, opposed to upper end 31, and comprising the lower end portions 32, 32 of front and back loops 23, 24. Frame 20 has a first side 41 comprising the side portions 33, 33 of front and back loops 23, 24, and frame 20 also has a second side 42 comprising side portions 34, 34 of front and back loops 23, 24.

Each of upper and lower frame ends 39, 40 comprises structure for receiving one of the opposed, vertical, directional forces to which frame 20 will be subjected, and frame ends 39, 40 have sufficient structural strength to render these frame ends relatively resistant to bending by the aforementioned opposed directional forces. Similarly, frame sides 41, 42 have sufficient structural strength to resist the tension developed by the aforementioned opposed, vertical, directional forces.

Press frame 20 may also include, as part of the force-resisting structure, a pair of vertically spaced, bolster members, namely upper bolster member 43 and lower bolster member 44. Both bolster members 43, 44 are located at interior opening 37 of press frame 20. Upper bolster member 43 abuts an inner edge 45 on upper end portion 31 of each loop 23, 24. Lower bolster member 44 abuts an inner edge 46 on lower end portion 32 of each loop 23, 24.

Each bolster member 43, 44 comprises structure for receiving a respective opposed directional force and for transferring that force to the loop end portions abutted by that bolster member. More particularly, upper bolster member 43 comprises structure for receiving an upwardly directed force and transfers that force to the upper end portions 31, 31 of front and back loops 23, 24 respectively. Similarly, lower bolster member 44 comprises structure for receiving a downwardly directed force and for transferring that force to lower end portions 32, 32 on front and back loops 23, 24 respectively.

Figure 9:
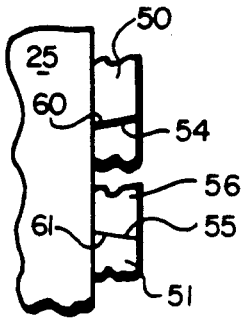
FIG. 9 is an enlarged, fragmentary, front view of a portion of the press frame of FIGS. 1-3.

Frame 20 comprises structure for urging each of bolster members 43, 44 toward the respective loop end portions 31, 32 abutted by that bolster member. More particularly, there are two pairs of vertically spaced elongated plates 50, 51, each pair being located adjacent a respective spacer member 25, 26 adjacent interior opening 37 of frame 20. As shown in FIG. 1, each upper plate 50 has a first or upper end 52 for abutting the lower surface of upper bolster member 43. Each lower plate 51 has a first or lower end 53 for abutting the upper surface of lower bolster member 44. As shown in FIG. 9, each plate 50, 51 has a tapered second end 54, 55 spaced from the second end of the other plate. A wedge plate 56 is located between each pair of upper and lower elongated plates 50, 51 at the adjacent spacer member 25 or 26, and wedge plate 56 is attached to the adjacent spacer member 25 or 26 by bolts located at 57, 58 respectively (FIGS. 1-3). Each wedge plate 56 has a pair of spaced-apart, converging ends 60, 61 each engaging a respective tapered end 54, 55 on elongated plates 50, 51 (FIG. 9). The angle at tapered ends 54, 55 and at mating converging ends 60, 61 may be 10 degrees from horizontal, for example.

The converging ends 60, 61 on the wedge plate and the tapered ends 54, 55 on the elongated plates cooperate to force elongated plates 50, 51 away from each other toward upper and lower bolster members 43, 44 respectively, in response to a tightening of the wedge plate bolts at locations 57 and 58. Additional bolts are provided, at locations 62 (FIGS. 1-3), for attaching the elongated plates 50, 51, adjacent spacer 25, to that spacer, and further additional bolts are provided, at locations 63, for attaching the elongated plates 50, 51, adjacent spacer member 26, to that spacer member. Elongated plates 50, 51 are initially attached to the spacer members by the bolts at 62, 63 in a relatively loose fashion. After bolts 57, 58 have been tightened against wedge plates 56, 56, to force the elongated plates away from each other toward upper and lower bolster member 43, 44, the bolts at 62, 63 are tightened.

Spacer member 25 and the two facing loop side portions 33, 33 between which spacer member 25 is located, define a recess 68 for receiving plates 50, 51 and 56 (FIG. 3). Similarly, spacer member 26 and facing loop side portions 34, 34 define a recess 69 for receiving plates 50, 51 and 56. Each bolster member 43, 44 has a pair of opposed neck portions 64, 65, and each neck portion 64, 65 is received within a respective one of the recesses 68, 69 defined by the spacer members and the adjacent loop side portions.

The interior opening 36 of each loop 23, 24 has a pair of opposed, upper stepped portions 66, 66 and a pair of opposed, lower stepped portions 67, 67 to assist in receiving and engaging upper and lower bolster members 43, 44 in their respective locations on frame 20.

Figure 5:
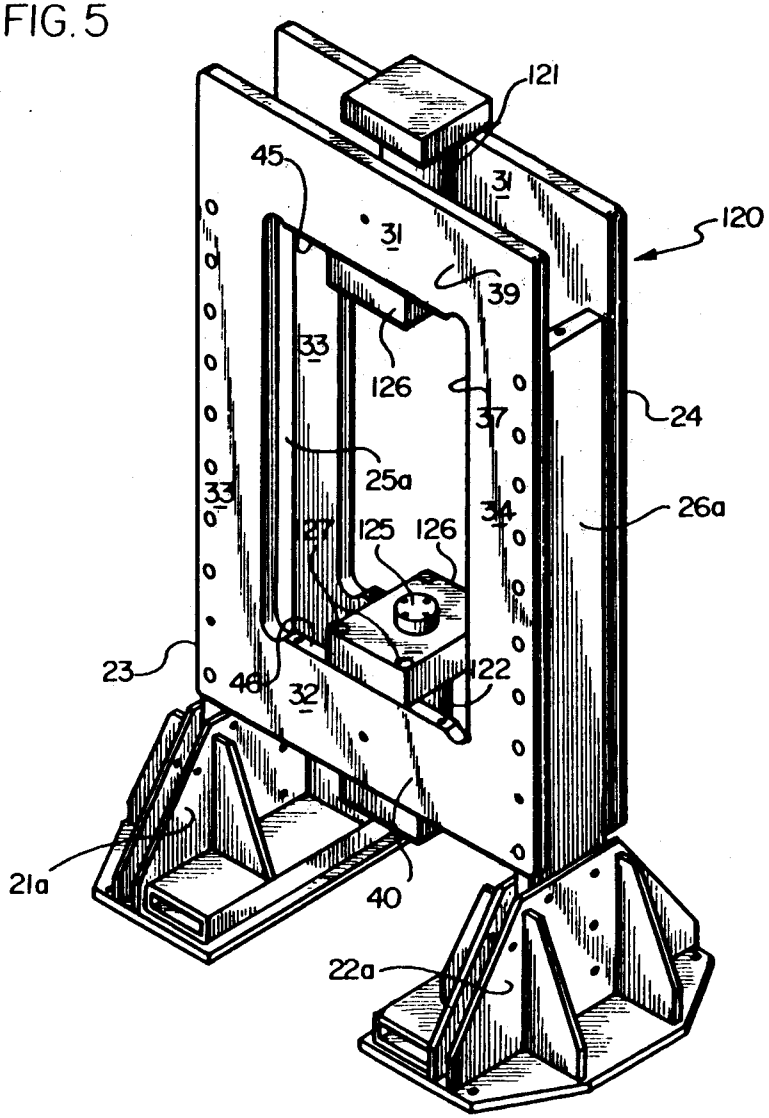
FIG. 5 is a perspective showing the press frame of FIG. 4 fully assembled.
Figure 4:
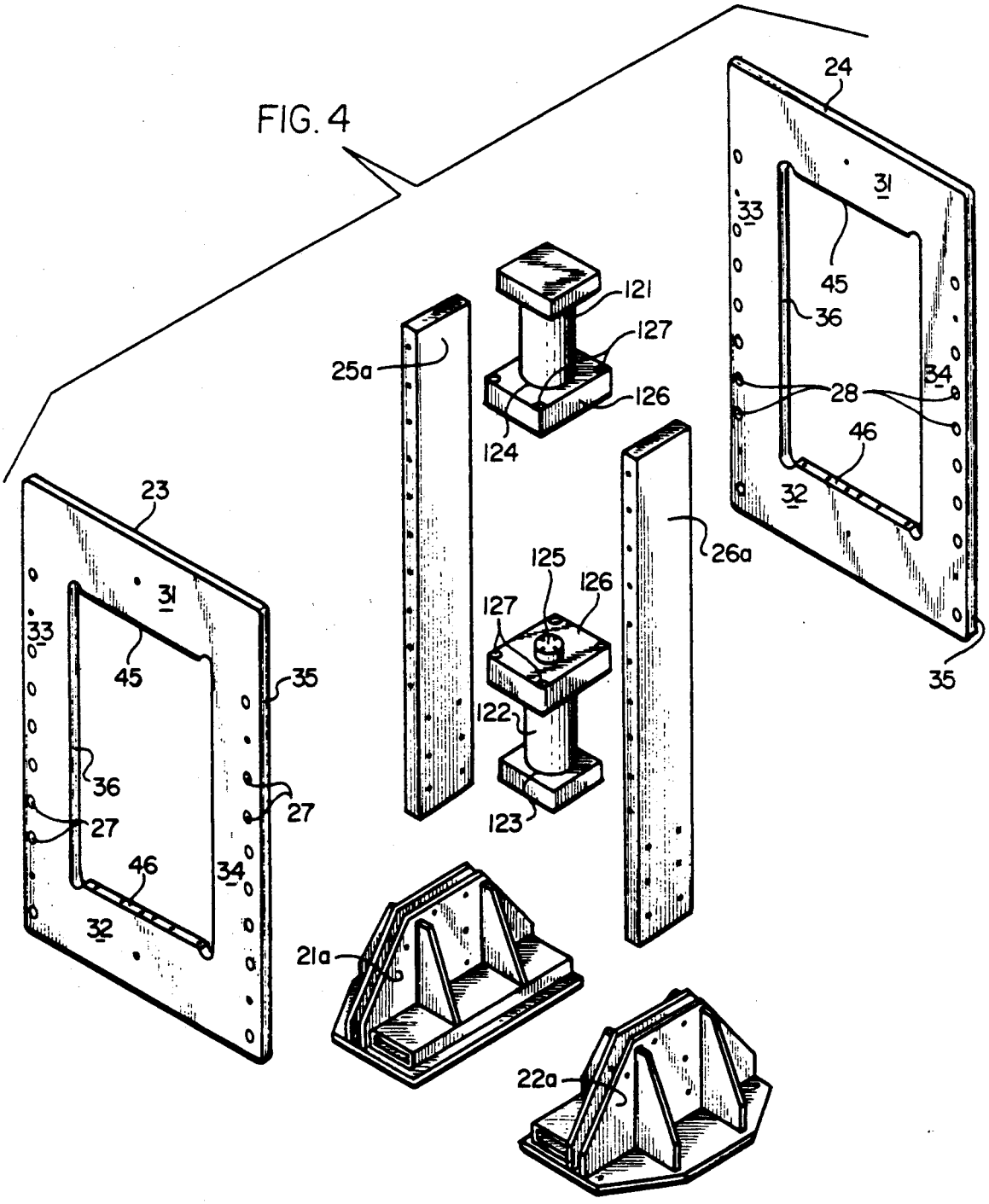
FIG. 4 is an exploded perspective of another embodiment of a press frame constructed in accordance with the present invention.

Referring now to FIGS. 4 and 5, indicated generally at 120 is another embodiment of a press frame constructed in accordance with the present invention. Press frame 120 is quite similar to press frame 20 illustrated in FIGS. 1-3, and many of the components are the same. Thus, like frame 20, frame 120 includes front and back loops 23, 24 connected together by spacer members 25a, 26a extending upwardly from pedestals 21a, 22a, and all the parts of frame 120 are connected together by bolts. Spacer members 25a, 26a are located between and abut facing side portions 33, 33, and 34, 34 of adjacent loops 23, 24 to form a space between facing end portions 31, 31 and 32, 32 of loops 23, 24 and between the facing side portions. The principal difference between frame 20 and frame 120 is that frame 120 does not include bolster members 43, 44 or structure (plates 50, 51, 56) for urging the bolster members toward the upper and lower ends of the frame. Instead, in frame 120, the opposed, vertical, directional forces are transferred to the upper and lower end portions 31, 32 of front and back loops 23, 24 by different structure now to be described.

As shown in FIG. 5, an upper hydraulic cylinder 121 is mounted adjacent upper end 39 of frame 120 between upper loop end portions 31, 31. Similarly, a lower hydraulic cylinder 122 is mounted adjacent lower end 40 of frame 120 between lower loop end portions 32, 32. Each cylinder 121, 122 extends vertically away from the interior opening 37 of press frame 120 in the space between a respective pair of facing loop end portions 31, 31 or 32, 32.

Each cylinder 121, 122 has a closed first end 123 and a second end 124. A piston rod 125 is connected to a fluid-actuated piston 128 (FIG. 6) contained within each hydraulic cylinder, and piston rod 125 extends outwardly from second end 124 of each cylinder. Attached to each cylinder 121, 122 adjacent the cylinder's second end 124 is a flange 126. Flange 126 on upper cylinder 121 abuts the inner edge 45 on the upper end portion 31 of each loop 23, 24. Similarly, flange 126 on lower cylinder 122 abuts the inner edge 46 on the lower end portion 32 of each loop 23, 24. Flanges 126, 126 are maintained in the abutting relationship described in the previous two sentences by fastening means in the form of bolts at locations 127.

Upper and lower cylinders 121, 122 generate a pair of opposed, vertical, directional forces. Flange 126 on upper cylinder 121 transfers the upwardly directed force to the upper loop end portion 31 on each of front and back loops 23, 24. Similarly, flange 126 on lower cylinder 122 transfers the downwardly directed force to the lower loop end portion 32 on each of loops 23, 24.

The opposed, vertical, directional forces exerted against press frame 20 of FIGS. 1-3 are generated by structure similar to that employed in frame 120 of FIGS. 4-5, with the differences noted below.

More particularly, in the embodiment of FIGS. 1-3, upper hydraulic cylinder 121 would extend through a central opening 47 in upper bolster member 43, and lower hydraulic cylinder 122 would extend through a central opening 48 in lower bolster member 44. Flange 126 on upper hydraulic cylinder 121 would engage against the bottom surface of upper bolster member 43, and flange 126 on lower hydraulic cylinder 122 would engage against the top surface of lower bolster member 44. Each flange 126 would be bolted to a respective upper or lower bolster member employing bolts located at locations similar to locations 127 in the embodiment of FIGS. 4-5. As in the embodiment of FIGS. 4-5, the hydraulic cylinders mounted on frame 20 of FIGS. 1-3 would generate a pair of opposed, vertical, directional forces. Flange 126 on lower hydraulic cylinder 122 would transfer the downwardly directed force to lower bolster member 44 (see FIG. 6). Similarly, flange 126 on upper hydraulic cylinder 121 would transfer the upwardly directed force to upper bolster member 43.

Figure 6:
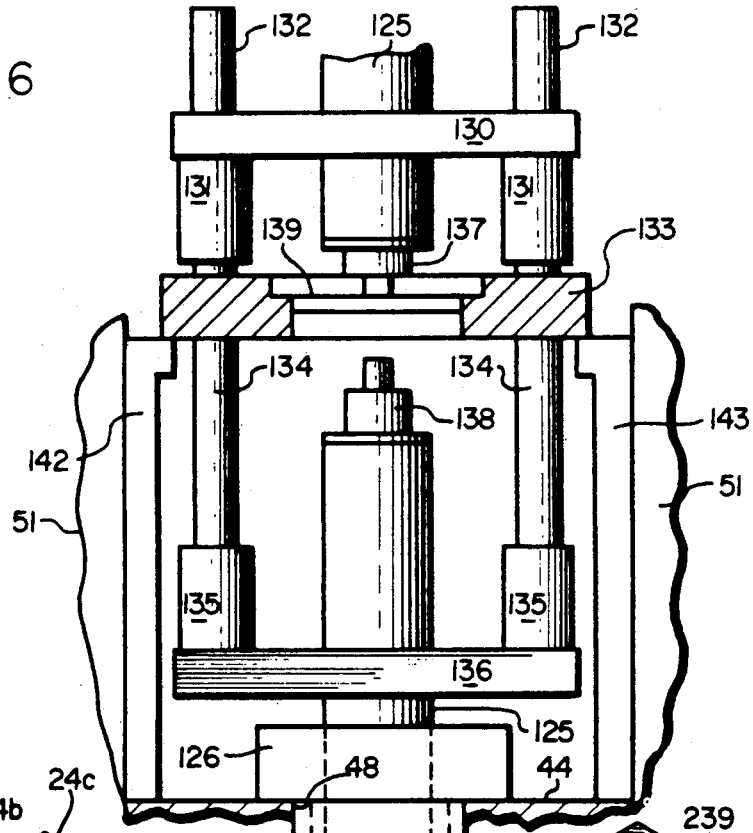
FIG. 6 is a fragmentary front view, partially in section, showing a die set used in conjunction with a press frame constructed in accordance with the present invention.

FIG. 6 illustrates a die set which may be used in conjunction with upper and lower hydraulic cylinders 121, 122. The die set includes a die shoe 133 mounted atop vertically disposed support members 142, 143 each of which is fastened, e.g. by bolts (not shown), to a lower elongated plate 51 in turn attached to a respective spacer member 25, 26 (FIG. 2). Support members 142, 143 rest atop lower bolster member 44 in the embodiment of FIGS. 1-3, for example. Extending upwardly from die shoe 133 are a pair of upper guide pins 132, 132 upon which are slidably mounted upper guide bushings 131, 131 extending downwardly from an upper punch holder 130 from which a punch 137 extends downwardly. Extending downwardly from die shoe 133 are lower guide pins 134, 134 on which are slidably mounted lower guide bushings 135, 135 extending upwardly from a lower punch holder 136 which carries a punch 138. Punches 137 and 138 cooperate with a die ring 139 on die shoe 133 to perform a pressing operation. Upper punch holder 130 is moved vertically by piston rod 125 from upper hydraulic cylinder 121, and lower punch holder 136 is moved vertically by piston rod 125 from lower hydraulic cylinder 122. Punch holders 130, 136 are engaged to piston rods 125 by clamping structure (not shown).

Figure 7:
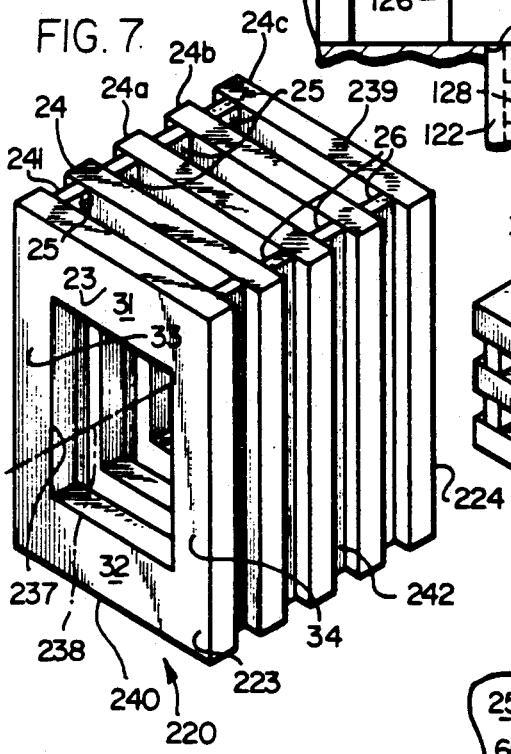
FIG. 7 is a perspective showing another embodiment of a force-resisting structure constructed in accordance with the present invention.

Referring to FIG. 7, indicated generally at 220, is another embodiment of force-resisting structure in accordance with the present invention. Force-resisting structure 220 is similar to force-resisting structure 20 of FIGS. 1-3 in that both structures 20 and 220 include a plurality of loops 23, 24 connected together by spacer members 25, 26, and all components are connected together by bolts. Structures 20 and 220 differ principally in the following respect. Whereas force-resisting structure 20 employs only front and back loops 23, 24, force-resisting structure 220 employs additional loops, e.g. 24a, 24b and 24c, a total of five loops compared to two loops in force-resisting structure 20.

In structure 220, each of the loops behind loop 24 is connected to the loop in front of it in a manner identical to that in which loop 24 is connected to front loop 23. Any two adjacent loops are connected together in unwelded, mutually parallel relation by spacer members 25, 26, as in force-resisting structure 20. The distance between adjacent loops may be determined by the width of spacer members 25, 26 which may be wider or narrower than spacer members 25, 26 in force-resisting structure 20, as the particular case may require. In a situation where maximum load resistance is required, spacer members 25, 26 could be eliminated entirely, and adjacent loops may be laminated together in abutting relationship, employing bolts at locations corresponding to locations 27 and 28 in force-resisting structure 20.

Structure 220 has upper and lower ends 239, 240, respectively, and opposite sides 241, 242, as well as an interior opening 237 having a center line 238. Opening 237 extends from the front 223 to the back 224 of structure 220.

Although no bolster members are shown in association with force-resisting structure 220, upper and lower bolster members, similar to bolster members 43, 44 in force-resisting structure 20 may be employed adjacent upper and lower ends 239, 240 at opening 237. The length of such bolster members would depend upon the number of loops employed in structure 220. The greater the number of loops, the greater the dimension of structure 220 from front to back, and correspondingly, the greater the length required for the bolster members. The bolster members employed in structure 220 would be held in place in a manner similar to that employed to hold bolster members 43, 44 in place in structure 20.

If desired, in addition to upper and lower bolster members (the primary bolster members), one may employ supplemental bolster members on the left and right sides 241, 242 of structure 220. This would produce a force-resisting structure that would be extremely resistant to forces in both the vertical direction (up and down as viewed in FIG. 7) and the lateral or horizontal direction (to the left and right as viewed in FIG. 7). The type of structure described in the preceding sentences of this paragraph would be useful in instances where an extremely strong tubular type configuration was desired. The supplemental bolster members would be held in place with structure similar to that employed to hold upper and lower bolster members 43, 44 in place in the embodiment of FIGS. 1-3.

In an arrangement employing supplemental bolster members, the supplemental bolster members would constitute a second pair of spaced apart, parallel bolster members each located within interior opening 237 of structure 220 and each abutting an inner edge of a respective side portion 33, 34 on each loop 23-24c of structure 220. Each supplemental bolster member would receive a respective opposed, horizontal, directional force, transverse to the opposed, vertical, directional forces received by the upper and lower primary bolster members, and each supplemental bolster member would transfer that horizontal, transverse force to the particular loop side portions 33 or 34 abutted by that supplemental bolster member.

Figure 8:
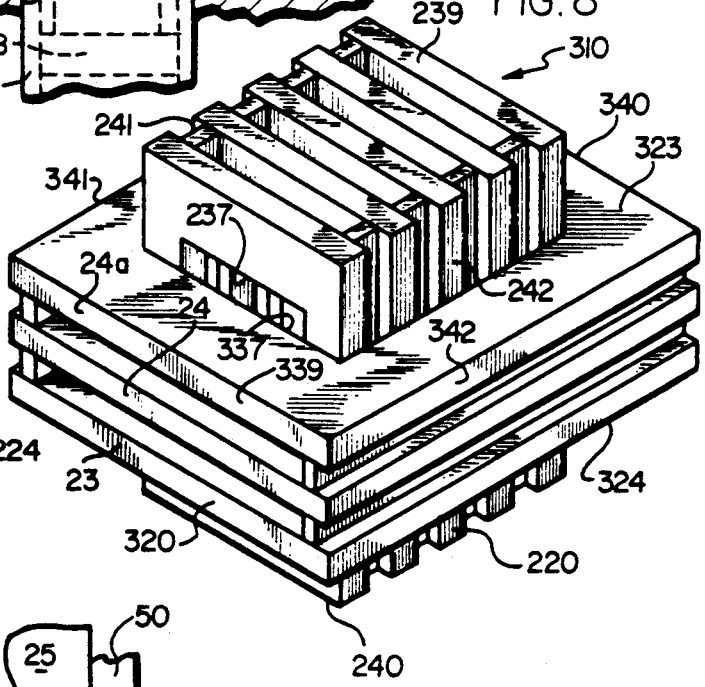
FIG. 8 is a perspective showing still another embodiment of a force-resisting structure constructed in accordance with the present invention.

Referring now to FIG. 8, indicated generally at 310 is a chamber capable of withstanding extremely high pressures. Chamber 310 comprises a first force-resisting structure 220 essentially the same as structure 220 discussed above in connection with FIG. 7, and a second force-resisting structure 320 disposed transversely to first force-resisting structure 220. Except for its transverse disposition relative to first structure 220, second structure 320 is essentially identical to first structure 220; and, although second structure 320 is shown in FIG. 8 as having three loops 23, 24 and 24a, compared to five loops 23-24c for first structure 220 (FIG. 7), second structure 320 may have additional loops, and this will be explained more fully below.

Second structure 320 comprises front and back ends 339, 340 and opposed sides 341, 342. Second structure 320 has an interior opening 337 extending from the top 323 to the bottom 324 of second structure 320. As noted above, interior opening 237 in first structure 220 has a center line 238 (FIG. 7). Second structure 320 has a center line (not shown) disposed transversely to center line 238 of first structure 220.

As shown in FIG. 8, interior opening 337 in second structure 320 receives first structure 220. First structure 220 is removably received as a unit within opening 337, and structure 220 may be separated as a unit from structure 320 by raising or lowering either of the two structures 220, 320, employing conventional hydraulic or mechanical elevating or depressing mechanisms.

Upper and lower ends 239, 240 of first structure 220 close interior opening 337 of second structure 320. Similarly, front and back ends 339, 340 of second structure 320 close interior opening 237 of first structure 220. Although an unclosed gap in interior opening 237 is shown in FIG. 8, that gap would normally be closed by additional loops, similar to loops 23, 24 and 24a, incorporated into second structure 220.

Upper and lower ends 239, 240 on first structure 220 receive and resist a first pair of opposed directional forces generated within chamber 310. Front end 339 and back end 340 on second structure 320 receive and resist a second pair of opposed directional forces, transverse to the first pair of opposed directional forces desribed in the preceding sentence, and which are also generated within chamber 340.

Sides 241, 242 on first structure 220 resist the tension developed by the opposed directional forces exerted against upper and lower ends 239, 240 of first structure 220. Similarly, sides 341, 342 of second structure 320 resist the tension developed by the transverse, opposed, directional forces exerted against front and back ends 339, 340 of second structure 320. Opposed directional forces generated within chamber 310 and which are directed toward sides 241, 242 of first structure 220 are resisted by sides 241, 242 which, in the case of such forces, are reinforced by sides 341, 342 of second structure 320.

Although not shown in FIG. 8, each of the two structures 220, 320 would preferably include bolster members similar to those employed in connection with the force-resisting structure illustrated in FIGS. 1-3. In the case of first structure 220, the bolster members would be located within interior opening 237, adjacent upper and lower ends 239, 240 of first structure 220. In the case of second structure 320, the bolster members would be located within interior opening 337 adjacent the front and back ends 339, 340 of second structure 220.

The bolster members employed in connection with first and second structures 220 and 320 would function in the same manner as the bolster members employed in connection with structure 20 illustrated in FIGS. 1-3, i.e. each bolster member would receive a respective opposed directional force and transfer that force to the loop end portions abutted by that bolster member.

Referring again to the embodiment illustrated in FIGS. 1-3, each of the separate components shown unassembled in FIG. 1 may be subjected to whatever machining operations are required while that component is separate and apart from the assembly of components illustrated in FIG. 3. No machining is necessary once the components have been brought together into the assembly illustrated in FIG. 3, and no machining is necessary once the components have been brought together into any subassembly of the assembly shown in FIG. 3. All of the components illustrated in FIG. 1 are bolted together into the final assembly of FIG. 3. No welding is performed, and the drawbacks and disadvantages attendant to welding are eliminated. Each of the individual components may be removed for repair or replacement merely by unbolting it from the assembly.

All of the features and advantages discussed above in connection with the embodiment of FIGS. 1-3 are also available with the embodiments illustrated in FIGS. 4-5, FIG. 7 and FIG. 8.

The foregoing detailed description has been given for clearness of understanding only, and no unnecessary limitations should be understood therefrom, as modifications will be obvious to those skilled in the art.

I claim:

1. A structure for resisting opposed directional forces, said structure comprising:

a plurality of substantially planar, metal loops;

each loop constituting a single piece formed from a single piece of metal plate;

each loop having a pair of spaced apart, opposed end portions;

each loop having a pair of spaced apart, opposed side portions extending between and integral with each of said end portions;

each of said end portions and each of said side portions on a loop having an exterior edge and an interior edge;

each loop having a periphery defined by said exterior edges and an opening defined by said interior edges;

each loop being devoid of any weld;

means for connecting said loops together in unwelded, mutually parallel relation to form said structure;

said connecting means comprising a pair of elongated spacer members each located between respective facing side portions of adjacent loops;

each loop opening being aligned with the opening of each adjacent loop to form an interior opening in said structure, said opening in said structure having a center line disposed transversely to the direction of the opposed forces resisted by said structure;

said structure having first and second opposed ends, each of said structure ends comprising a plurality of said loop end portions;

said structure having a pair of sides, each of said structure sides comprising a plurality of said loop side portions;

each of said structure end comprising means for receiving one of said opposed directional forces;

said structure ends being relatively resistant to bending by said opposed directional forces;

said sides of the structure comprising means for resisting the tension developed by said opposed directional forces;

and a pair of spaced apart, parallel bolster members each located within said interior opening of said structure and each abutting an inner edge of an end portion on each loop;

each bolster member comprising means for receiving a respective opposed directional force and for transferring said force to each loop end portion abutted by that bolster member;

each side portion on each loop facing a respective side portion on each adjacent loop;

said structure comprising structural means for urging each of said bolster members toward each loop end portion abutted by that bolster member;

each spacer member and the two facing loop side portions, between which said spacer member is located, defining a recess for receiving said structural urging means;

each bolster member having a pair of opposed neck portions;

each of said neck portions being received within a respective one of said recesses.

2. A structure for resisting opposed directional forces, said structure comprising:

a plurality of substantially planar, metal loops;

each loop constituting a single piece formed from a single piece of metal plate;

each loop having a pair of spaced apart, opposed end portions;

each loop having a pair of spaced apart, opposed side portions extending between and integral with each of said end portions;

each of said end portions and each of said side portions on a loop having an exterior edge and an interior edge;

each loop having a periphery defined by said exterior edges and an opening defined by said interior edges;

each loop being devoid of any weld;

means for connecting said loops together in unwelded, mutually parallel relation to form said structure;

each loop opening being aligned with the opening of each adjacent loop to form an interior opening in said structure, said opening in said structure having a center line disposed transversely to the direction of the opposed forces resisted by said structure;

said structure having first and second opposed ends, each of said structure ends comprising a plurality of said loop end portions;

said structure having a pair of sides, each of said structure sides comprising a plurality of said loop side portions;

each of said structure ends comprising means for receiving one of said opposed directional forces;

said structure ends being relatively resistant to bending by said opposed directional forces;

said sides of the structure comprising means for resisting the tension developed by said opposed directional forces;

each side portion on each loop facing a respective side portion on each adjacent loop, and each end portion on each loop facing a respective end portion on each adjacent loop;

said connecting means for the loops comprising a pair of elongated spacer members extending in length substantially between said first and second opposed ends of said loops, each of said spacer members being located between and abutting respective facing side portions of adjacent loops to form a space between the facing end portions and the facing side portions of adjacent loops;

means for generating one of said opposed directional forces;

and means mounting said force-generating means adjacent an end of said structure;

said force-generating means comprising a fluid-actuated piston contained within a cylinder having a closed first end and a second end;

a piston rod connected to said piston and extending outwardly through said second end of the cylinder;

said cylinder extending vertically, away from said interior opening of said structure, in the space between a pair of facing loop end portions of adjacent loops;

said mounting means for the force-generating means comprising a flange attached to said cylinder adjacent said second end thereof and abutting said inner edges of said pair of facing loop end portions.

3. A structure for resisting opposed directional forces, said structure comprising:

a plurality of substantially planar, metal loops;

each loop constituting a single piece formed from a single piece of metal plate;

each loop having a pair of spaced apart, opposed end portions;

each loop having a pair of spaced apart, opposed side portions extending between and integral with each of said end portions;

each of said end portions and each of said side portions on a loop having an exterior edge and an interior edge;

each loop having a periphery defined by said exterior edges and an opening defined by said interior edges;

each loop being devoid of any weld;

means for connecting said loops together in unwelded, mutually parallel relation to form said structure;

each loop opening being aligned with the opening of each adjacent loop to form an interior opening in said structure, said opening in said structure having a center line disposed transversely to the direction of the opposed forces resisted by said structure;

said structure having first and second opposed ends, each of said structure ends comprising a plurality of said loop end portions;

said structure having a pair of sides, each of said structure sides comprising a plurality of said loop side portions;

each of said structure ends comprising means for receiving one of said opposed directional forces;

said structure ends being relatively resistant to bending by said opposed directional forces;

said sides of the structure comprising means for resisting the tension developed by said opposed directional forces;

each side portion on each loop facing a respective side portion on each adjacent loop, and each end portion on each loop facing a respective end portion on each adjacent loop;

said connecting means for the loops comprising a pair of elongated spacer members extending in length substantially between said first and second opposed ends of said loops, each of said spacer members being located between and abutting respective facing side portions of adjacent loops;

a pair of spaced apart, parallel bolster member each located with said interior opening of said structure and each abutting an inner edge of an end portion on each loop;

means for generating one of said opposed directional forces;

and means mounting said force-generating means on one of said bolster members;

said force-generating means comprising a fluid-actuated piston contained within a cylinder having a closed first end and a second end;

a piston rod connected to said piston and extending outwardly through said second end of the cylinder;

said cylinder extending vertically away from said interior opening of said structure, in the space between a pair of facing loop end portions of adjacent loops;

said one bolster member having an inner surface facing the interior opening of said structure and an opening through which said cylinder extends;

said mounting means for the force-generating means comprising a flange attached to said cylinder adjacent said second end thereof and abutting said inner surface of said bolster member.

4. A structure for resisting opposed directional forces, said structure comprising:

a plurality of substantially planar, metal loops;

each loop constituting a single piece formed from a single piece of metal plate;

each loop having a pair of spaced apart, opposed end portions;

each loop having a pair of spaced apart, opposed side portions extending between and integral with each of said end portions;

each of said end portions and each of said side portions on a loop having an exterior edge and an interior edge;

each loop having a periphery defined by said exterior edges and an opening defined by said interior edges;

each loop being devoid of any weld;

means for connecting said loops together in unwelded, mutually parallel relation to form said structure;

said connecting means comprising a pair of elongated spacer members each located between respective facing side portions of adjacent loops;

each loop opening being aligned with the opening of each adjacent loop to form an interior opening in said structure, said opening in said structure having a center line disposed transversely to the direction of the opposed forces resisted by said structure;

said structure having first and second opposed ends, each of said structure ends comprising a plurality of said loop end portions;

said structure having a pair of sides, each of said structure sides comprising a plurality of said loop side portions;

each of said structure ends comprising means for receiving one of said opposed directional forces;

a pair of spaced apart, parallel bolster members each located within said interior opening of said structure and each abutting an inner edge of an end portion on each loop;

each bolster member comprising means for receiving a respective opposed directional force and for transferring said force to each loop end portion abutted by that bolster member;

each side portion on each loop facing a respective side portion on each adjacent loop;

a pair of elongated plates located adjacent each spacer member;

each elongated plate in said pair having (a) a first end abutting a respective one of said bolster members and (b) a tapered second end spaced from the second end of the other elongated plate in said pair;

a wedge plate located between the elongated plates in said pair, at the adjacent spacer member;

said wedge plate having a pair of space-apart, converging ends each engaging a respective tapered end on one of said elongated plates;

first bolt means for attaching said wedge plate to the adjacent spacer member;

said converging ends on the wedge plate and said tapered second ends on said elongated plates comprising means cooperating to urge said elongated plates away from each other toward said bolster members, in response to a tightening of said first bolt means;

and additional bolt means for attaching said pair of elongated plates to the adjacent spacer member.

5. In combination, a first structure for resisting opposed directional forces, and a second structure for resisting opposed directional forces transverse to the opposed directional forces resisted by said first structure, each of said structures comprising:

a plurality of substantially planar, metal loops;

each loop constituting a single piece formed from a single piece of metal plate;

each loop having a pair of spaced apart, opposed end portions;

each loop having a pair of spaced apart, opposed side portions extending between and integral with each of said end portions;

each of said end portions and each of said side portions on a loop having an exterior edge and an interior edge;

each loop having a periphery defined by said exterior edges and an opening defined by said interior edges;

each loop being devoid of any weld;

and means for connecting said loops together in unwelded, mutually parallel relation to form said structure;

each loop opening being aligned with the structure of each adjacent loop to form an interior opening in said structure, said opening in said structure having a center line disposed transversely to the direction of the opposed forces resisted by said structure;

each structure having first and second opposed ends, each of said structure ends comprising a plurality of said loop end portions;

each structure having a pair of sides, each of said structure sides comprising a plurality of said loop side portions;

each of said structure ends comprising means for receiving one of said opposed directional forces resisted by that structure;

said structure ends being relatively resistant to bending by the opposed directional forces resisted by that structure;

said sides of each structure comprising means for resisting the tension developed by the opposed directional forces resisted by that structure;

in said combination, said center line of the interior opening in said second structure being disposed transversely to the center line of said interior opening in said first structure;

said interior opening in said first structure, comprising means for receiving said first-recited structure;

in each structure, a pair of spaced apart, parallel bolster members each located within the interior opening of said structure and each abutting an inner edge of an end portion on each loop of said structure;

each bolster member in each pair comprising means for receiving a respective opposed directional force and for transferring said force to the loop end portions abutted by that bolster member;

each bolster member in each pair comprising means for receiving and transferring a respective opposed directional force transverse to the opposed forces received and transferred by the bolster members in the other pair.

6. A structure as recited in claim 5 wherein:

each spacer member and the two facing loop side portions, between which said spacer member in located, define a recess for receiving a pair of said elongated plates and a wedge plate;

each bolster member has a pair of opposed neck portions;

and each of said neck portions is received within a respective one of said recesses.

7. A structure for resisting opposed directional forces, said structure comprising:

a plurality of substantially planar, metal loops;

each loop constituting a single piece formed from a single piece of metal plate;

each loop having a pair of spaced apart, opposed end portions;

each loop having a pair of spaced apart, opposed side portions extending between and integral with each of said end portions;

each of said end portions and each of said side portions on a loop having an exterior edge and an interior edge;

each loop having a periphery defined by said exterior edges and an opening defined by said interior edges;

each loop being devoid of any weld;

means for connecting said loops together in unwelded, mutually parallel relation to form said structure;

each loop opening being aligned with the opening of each adjacent loop to form an interior opening in said structure, said opening in said structure having a center line disposed transversely to the direction of the opposed forces resisted by said structure;

said structure having first and second opposed ends, each of said structure ends comprising a plurality of said loop end portions;

said structure having a pair of sides, each of said structure sides comprising a plurality of said loop side portions;

each of said structure ends comprising means for receiving one of said opposed directional forces;

said structure ends being relatively resistant to bending by said opposed directional forces;

said sides of the structure comprising means for resisting the tension developed by said opposed directional forces;

a first pair of spaced apart, parallel bolster members each located within said interior opening of said structure and each abutting an inner edge of an end portion on each loop;

each bolster member in said first pair comprising means for receiving a respective opposed directional force and for transferring said force to the loop end portions abutted by the bolster member;

a second pair of spaced apart, parallel bolster members each located within said interior opening of said structure and each abutting an inner edge of a side portion on each loop;

each bolster member in said second pair comprising means for receiving a respective opposed directional force transverse to the opposed directional forces received by said first pair of bolster members and for transferring said transverse force to the loop side portions abutted by that bolster member.

8. In combination, a first structure for resisting opposed directional forces, and a second structure for resisting opposed directional forces transverse to the opposed forces resisted by said first structure, each of said structures comprising:

a plurality of substantially planar, metal loops;

each loop constituting a single piece formed from a single piece of metal plate;

each loop having a pair of spaced apart, opposed end portions;

each loop having a pair of spaced apart, opposed side portions extending between and integral with each of said end portions;

each of said end portions and each of said side portions on a loop having an exterior edge and an interior edge;

each loop having a periphery defined by said exterior edges and an opening defined by said interior edges;

each loop being devoid of any weld;

means for connecting said loops together in unwelded, mutually parallel relation to form said structure;

each loop opening being aligned with the opening of each adjacent loop to form an interior opening in said structure, said opening in said structure having a center line disposed transversely to the direction of the opposed forces resisted by said structure;

each structure having first and second opposed ends, each of said structure ends comprising a plurality of said loop end portions;

each structure having a pair of sides, each of said structure sides comprising a plurality of said loop side portions;

each of said structure ends comprising means for receiving one of said opposed directional forces resisted by that structure;

said structure ends being relatively resistant to bending by the opposed directional forces resisted by that structure;

said sides of each structure comprising means for resisting the tension developed by the opposed directional forces resisted by that structure;

in said combination, said center line of the interior opening in said second structure being disposed transversely to the center line of said interior opening in the first-recited structure;

said second structure comprising means, including said interior opening in said second structure, for removably receiving said first structure as a unit.

9. In the combination of claim 8 wherein:

said first end on the first recited structure comprises the loop end portions at one end of the loops forming said first-recited structure and said second end thereon comprises the loop end portions at the other end of the loops forming said first-recited structure;

said first end on the second structure comprises the loop end portions at one end of the loops forming said second structure and said second end thereon comprises the loop end portions at the other end of the loops forming said second structure;

said first and second ends on the first-recited structure comprise means for closing the interior opening in said second structure;

and said first and second ends on the second structure comprise means for closing the interior opening in said first-recited structure.

* * * * *